United States Patent [19]

Ohara et al.

[11] 4,265,531

[45] May 5, 1981

[54] ELECTROPHOTOGRAPHY

[75] Inventors: Katsunobu Ohara, Kawasaki; Nobutoshi Yoshida, Yokohama, both of Japan

[73] Assignee: Canon Kabushiki Kaisha, Tokyo, Japan

[21] Appl. No.: 954,782

[22] Filed: Oct. 24, 1978

Related U.S. Application Data

[63] Continuation of Ser. No. 792,094, Apr. 29, 1977, abandoned.

[30] Foreign Application Priority Data

May 19, 1976 [JP] Japan ..... 51-57465

[51] Int. Cl.[3] ..... G03G 15/00

[52] U.S. Cl. ..... 355/3 SC; 430/53; 430/68

[58] Field of Search ..... 96/1 R, 1 C; 355/3 SC, 355/14

[56] References Cited

U.S. PATENT DOCUMENTS

| | | | |
|---|---|---|---|
| 2,836,725 | 5/1958 | Vyverberg | 96/1 C |
| 2,856,533 | 10/1958 | Rosenthal | 96/1 C X |
| 2,868,989 | 1/1959 | Haacke | 96/1 C X |
| 2,879,395 | 3/1959 | Walkup | 96/1 C |
| 3,881,818 | 5/1975 | McFarlane et al. | 355/3 SC |
| 3,900,852 | 8/1975 | Raschke | 355/3 SC |
| 4,021,109 | 5/1977 | Tanaka et al. | 355/3 SC |

*Primary Examiner*—R. L. Moses

*Attorney, Agent, or Firm*—Fitzpatrick, Cella, Harper & Scinto

[57] ABSTRACT

Disclosed is a method for protecting a primary electrostatic latent image formed on a screen type photosensitive member. In the step for modulating ion streams or toner particle streams by the primary electrostatic latent image, due to a bias voltage impressed on the screen type photosensitive member natural corona discharge is generated by a corona discharge electrode used for forming a primary electrostatic latent image or natural discharge is generated between the photosensitive member and a conductor located close thereto so that the degradation or destruction of the primary electrostatic latent image result. The present invention provides the methods for solving this problem by electrically isolating the photosensitive member, the corona discharge electrodes and other conductors in the vicinity of the photoconductive member when a bias voltage is impressed on the latter.

28 Claims, 10 Drawing Figures

ELECTROPHOTOGRAPHY

This is a continuation, of application Ser. No. 792,094, filed Apr. 29, 1977, now abandoned.

BACKGROUND OF THE INVENTION

The present invention relates to a method for forming an image with a screen type photosensitive member (to be referred to as "a screen" in this specification) formed with a large number of very fine through openings or pores and more particularly the methods for protecting a primary electrostatic latent image.

DESCRIPTION OF THE PRIOR ART

A screen used in the present invention consists of a sensitive member comprised of a photoconductive member and an electrically conductive member (to be referred to as "a conductive member" in this specification) with or without an electrically insulating or isolation member and formed with a large number of very fine through openings or pores. A primary electrostatic latent image is formed over the screen in the steps to be described in detail hereinafter, and controls the ion streams passing through the openings or apertures of the screen in response to the pattern of the primary electrostatic latent image, whereby a secondary electrostatic latent image may be formed on a chargeable or recording member. The electrostatic copying methods of the type described are described in for instance U.S. Pat. No. 3,680,954, No. 3,582,206 and No. 3,645,614. In addition to the above methods, there has been devised and demonstrated a method and apparatus wherein a screen of the type described is used to effect a number of ion stream modulations with a single primary electrostatic latent image. In one type of electrostatic copying apparatus a screen is provided in the form of a drum so that a primary electrostatic latent image may be formed on the drum that is rotating. In some apparatus the screen drum; that is, the screen in the form of a drum is opposed relation with a corona discharger used for forming a primary electrostatic latent image and conductors of shielding members or plates. During the modulation step, a high voltage is impressed between the screen drum and a chargeable member or recording sheet to generate electric fields so that corona ion streams may be directed from a corona ion source to the chargeable member. No problem arises when the screen is grounded, but when the screen is impressed with a high voltage and if this voltage is set higher than a corona discharge initiating voltage at which the corona discharger used for the ion stream modulation and other conductors located adjacent the screen drum initiate corona discharges, the corona discharger used for the formation of a primary latent image tends to initiate natural discharges very often even when its high-voltage power supply is kept turned off and the conductors are grounded. The natural corona discharge causes the degradation in quality or destruction of the primary electrostatic latent image so that a large number of modulations with the single primary latent image cannot be accomplished or a number of effective modulation may be considerably decreased.

SUMMARY OF THE INVENTION

In view of the above the primary object of the present invention is to provide a method for eliminating the natural generation of corona discharges from conductors located adjacent a screen and conductive parts of corona dischargers used for the formation of a primary electrostatic latent image, whereby the degradation in quality or destruction of the primary latent image may be substantially eliminated and consequently the ion stream modulation or the retention copying with a single primary latent image may be cycled a large number of times.

According to the present invention, to the above and other ends, the corona discharge between the conductors located in the vicinity of the screen and the screen can be eliminated when a bias voltage is kept impressed on the screen. The conductors placed in the vicinity of the screen are electrodes and shielding members of corona dischargers, shielding members used in an optical system, dust shielding members, electrodes and structural parts made of metals of an electrostatic copying machine or apparatus. Briefly stated, to attain the object of the present invention, the latter provides a method (I) for keeping the conductors in an electrically isolated state at least when the screen is impressed with a bias voltage, a method (II) coating or otherwise with an electrically insulating or isolation material the surface of each of the conductors located adjacent to the screen, a method (III) for interposing an isolation member between the screen and each of the conductors at least when the screen is impressed with a bias voltage, and a method (IV) for impressing on each of the conductors a bias voltage so that the difference in potential between the screen and each of the conductors may be kept lower than a corona discharge initiating voltage when the screen is impressed with a bias voltage.

In this specification, the term "primary electrostatic latent image" refers to one formed on the screen through a sequence of predetermined latent image forming steps; the term "secondary latent image", one formed on a chargeable member by the modulation of ion streams by the primary electrostatic latent image formed on the screen; and the term "retention copying", a process for reproducing a plurality of copies from the same primary latent image.

DETAILED DESCRIPTION OF THE PREFERRED EMBODIMENTS

Prior to the description of the preferred embodiments of the present invention, the construction of a screen used therein and the steps of forming a latent image with this screen will be briefly described. Since the construction and the steps are described in detail in U.S. patent application Ser. No. 480,280 assigned to the same assignee, further reference is made to said application.

Figure 1:
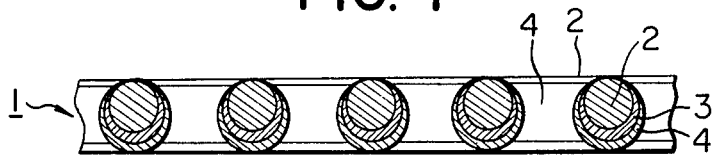
FIG. 1 is a fragmentary, schematic, on enlarged scale of a screen used in the present invention.

In FIG. 1 there is shown in a fragmentary schematic view, on enlarged scale a screen 1 consisting of an electrically conductive member 2, a photosensitive member 3 and a surface insulating member 4. The insulating members 4 are located on one major surface and open ends of the screen 1 whereas the conductive member 2 is exposed at the other major surface out of the layers of the remaining members.

Next the method for providing the screen 1 with the above construction will be described. Used as the electrically conductive member 2 is a wire screen or gauze consisting of fine metal wires or a metallic plate which has been subjected to etching to form a large number of fine openings or pores. When the screen is used in a copying machine used in an office or the like, 100 to 500 mesh is preferable. The conventional photosensitive compounds may be used as the photoconductive member 3 and may be coated on one major surface of the conductive member 2 by any suitable conventional methods such as vacuum deposition, sputtering, spraying coating and so on. In coating the photoconductive material may be permitted to adhere to the edges of apertures or meshes of the conductive member 2. The thickness of the photoconductive member or layer 3 is dependent upon the properties of the photoconductive material used and the mesh of the conductive member 2 and the maximum thickness is preferably between 10 and 80 microns.

Next the insulating member 4 will be described. It may be a polymetric compound having a high electrical resistance and better charge retainability. The insulating member 4 may be formed on the photoconductive member or layer 3 by spray coating or vacuum evaporation, the thickness being depending upon the thickness of the photoconductive member 3. The conductive member 2 is exposed from one major surface of the screen, and when the photoconductive member 3 and the insulating member 4 are further exposed, an additional electrically conductive member may be applied over them or an abrasive agent may be used to remove them.

Next the steps for forming a latent image with the screen 1 with the construction described above will be described with reference to FIGS. 2 through 5. It is assumed that in the steps to be described below the photoconductive member 3 be made of a photoconductive material such as selenium or other alloys in which the majority carriers are holes.

Figure 2:
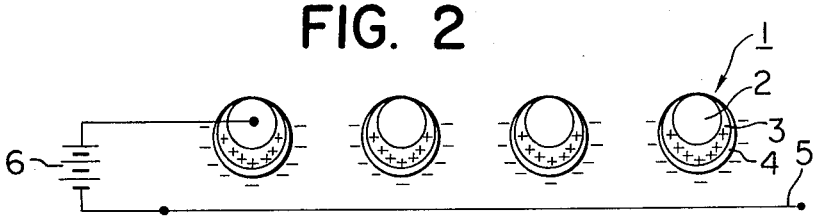
FIGS. 2 through 4 show the steps for forming a primary electrostatic latent image.

FIG. 2 shows a primary voltage impression or charging step in which the screen 1 is negatively charged with a corona wire 5 of charging means or corona discharger connected to a high-voltage source 6. When charged, formed around or in the vicinity of the insulating member 4 of the photoconductive member 3 is a positively charged layer; that is, the layer which is charged opposite in polarity to the screen 1.

Figure 3:
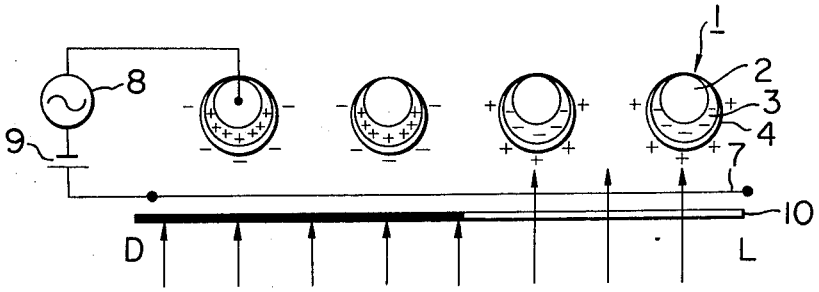

FIG. 3 shows a step wherein the screen 1 which has underwent the first step described above is subjected to a second voltage impression or charging simultaneous with an exposure. That is, the second voltage impression or charging is effected with a corona discharger wherein a positive DC voltage is superposed on AC voltage. In FIG. 3, the reference numeral 7 denotes a corona wire; 8, an AC power source; 9, a DC power source superposed on the AC power source 8; and 10, an original with a dark area D and a light area L, the arrows indicating the light rays from a light source. When only AC corona discharge were used, the surface potential of the insulating member 4 would be zero, but in reality the positive corona discharge is stronger than the negative corona discharge so that the positive bias voltage is superimposed on the AC voltage to cause the insulating member 4 to have a positive surface potential. As a result, after the exposure an exposed area of the photoconductive member 3 becomes conductive whereas the exposed area of the insulating member 4 has a positive surface potential. On the other hand, the unexposed areas of the photoconductive member 3 and the insulating member 4 remain negatively charged.

After the second step described above, the area of the insulating member 4 opposite to the corona wire 7 is positively charged faster than the aperture or mesh area so that in the exposed area of the screen 1 the potential is gradually increased from the major surface at which the conductive member 2 is exposed to the other major surface.

Figure 4:
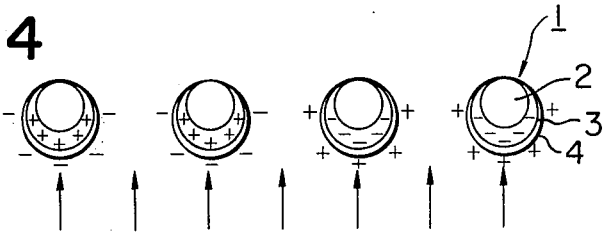

FIG. 4 shows a step wherein the screen 1 is subjected to a whole-surface illumination so that a primary electrostatic latent image is formed. The arrows indicate that the screen 1 is uniformly illuminated. The photoconductive member 3 may be coated in such a way that its thickness may be smoothly and gradually thined toward the openings or meshes. As a result, the charged layer is abruptly changed depending upon the charge on the surface so that the potential on the insulating member 4 changes gradually to more negative from one major surface of the screen 1 at which is exposed the conductive member to the other major surface.

Figure 5:
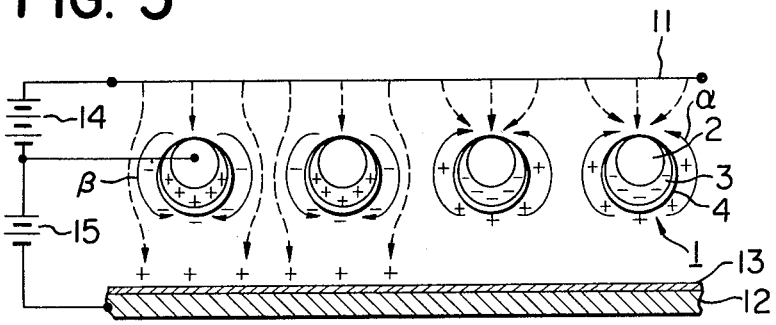
FIG. 5 illustrates the formation of a secondary electrostatic image on a chargeable member.

FIG. 5 shows a positive secondary electrostatic latent image forming step, and reference numeral 11 denotes a corona wire used for generating corona ions used for modulation; 12, an electrode placed in opposed relation with the corona wire 11 for generating an electric field between the screen 1 and a recording member 13 so that the ions that have passed through the screen 1 may be directed toward the recording member 13; the recording member 13 is placed upon the electrode 12 and is spaced apart from the screen 1 by a suitable distance between 1 and 10 mm; 14, a high-voltage source connected to the corona wire 11; and 15, a power supply connected to the electrode 12. The power sources 14 and 15 are so connected that when the conductive member 2 of the screen 1 is grounded, the power source 14 may cause the corona discharge wire 11 to be negatively charged whereas the power source 15 may cause the electrode 12 to be positively charged. The potential impressed on the electrode 12 is dependent upon the distance between the screen 1 and the recording member 13 and is of the order of 1 mm/KV.

When the corona ion streams are directed from the corona discharge wire 11 to the recording member 13 under the conditions described above, the ion streams are suppressed by the electric field $\alpha$ generated in the exposed area of the screen 1 by the charges on the insulating member 4, whereas the electric field indicated by the solid lines $\beta$ is generated in the unexposed area so that the acceleration of ion streams results.

When the conductive member 2 is entirely covered, it is charged with the ions from the wire 11 so that the primary electrostatic latent image is destructed and consequently the secondary electrostatic latent image cannot be formed by retention. If a negative secondary electrostatic latent image is desired, the polarities of the voltages impressed on the corona discharge wire 11 and the electrode 12 are reversed.

The screen 1 may permit the retention copying because (I) the primary electrostatic latent image having a smooth potential graduation may be formed over the insulating member 4 which is extended from one major surface to the other major surface of the screen 1 and (II) the conductive member 2 of the screen 1 may be absorb the excessive corona streams which may cause the distortion of the primary electrostatic latent image in modulation.

Figure 6:
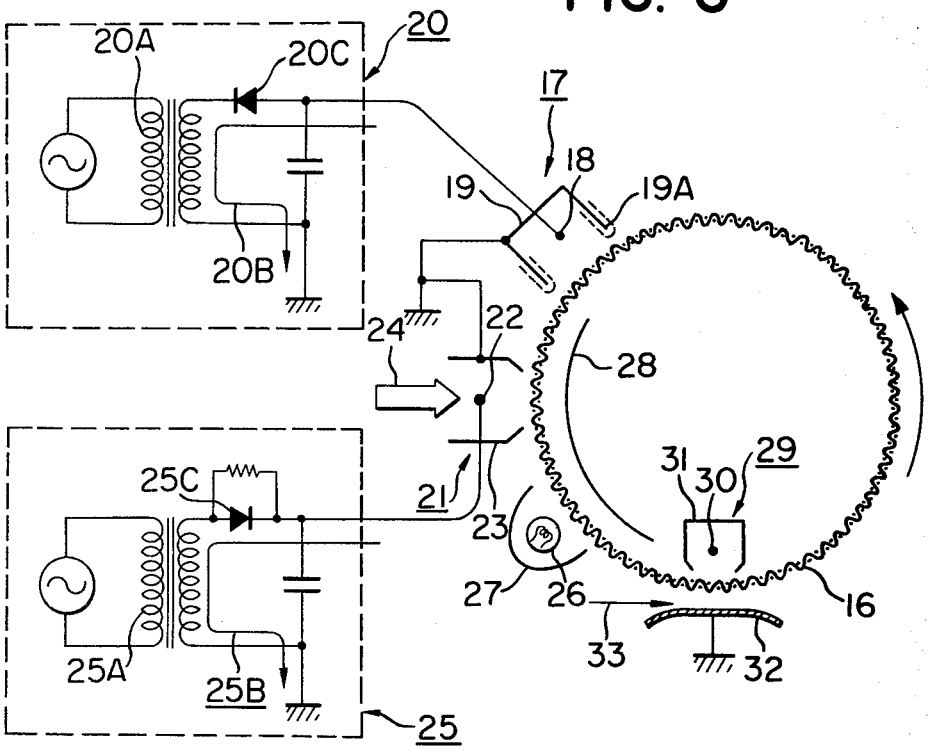
FIG. 6 is a schematic cross sectional view of a latent image forming station to which is applied the present invention.

In FIG. 6 there is shown a latent image forming station with the screen 1 of the type described above. In FIG. 6 reference numeral 16 denotes a drum made of the screen 1 in such a way that one major surface at which is exposed the conductive member 2 may define the interior surface; 17, a first corona discharger for primary voltage impression; 18, a corona wire; 19, a shielding plate; 20, a power supply for the first corona discharger 17 for impressing the negative voltage on the corona wire 18; 21, a second corona discharger for secondary voltage impression; 22, a corona wire; 23, a shielding plate having its back wall formed with an opening for exposing the screen drum 1 as indicated by an arrow 24; and 25, a power supply for the second corona discharger 21 for impressing a relatively strong positive AC voltage on the corona wire 22. Both the shielding plates 19 and 23 of the first and second corona dischargers 17 and 21 are grounded. Reference numeral 26 denotes a light source or lamp; 27, a shielding plate; 28, a shielding plate mounted within the screen drum 16; 29, a third corona discharger for modulation with a corona wire 30 and a shielding plate 31; and 32, an electrode disposed in opposed relation with the corona wire 30 and grounded. A secondary electrostatic latent image is formed on the electrode 32, and a positive voltage is impressed on the corona wire 30 when a positive image is formed from a positive original whereas a negative voltage is impressed if a negative image is formed from the positive original. The electric fields are generated between the screen drum 16 and the electrode 32 so that the ion streams emitted from the corona wire 30 may pass through the apertures or meshes of the screen drum 16 and may be subsequently directed toward the electrode 32. Therefore if a positive image is desired a positive voltage is impressed on the conductive member 2 of the screen drum 16 whereas if a negative image is desired, a negative voltage is impressed.

Next the mode of operation will be described. The primary electrostatic latent image is formed when the screen drum 16 is rotated in the direction indicated by the arrow and is sequentially subjected to the primary voltage impression by the first corona discharger 17, the secondary voltage impression by the second corona discharger simultaneous with the exposure and the whole-surface exposure by the light from the lamp 26. Thereafter the ion streams are modulated by the primary electrostatic latent image thus formed and are directed toward the electrode 32 so that a secondary electrostatic latent image is formed on a recording member transported in the direction indicated by an arrow 33 over the electrode 32. Thus formed secondary electrostatic latent image is developed at a developing station in an conventional developing process.

When the retention copying is cycled with the screen drum 16 of the type described and by utilizing the ion modulation, the following problems arise in some cases because the primary electrostatic latent image formed over the screen drum 16 has to pass through the first corona discharger 17, the second corona discharger 21, and between the shielding plates 27 and 28 of the whole-surface illumination lamp 26. First the problems caused when the primary electrostatic latent image passes through the first and second corona dischargers 17 and 21 will be specifically described.

When the screen drum 16 is impressed with a bias voltage, one of the terminals of the high-voltage power supplies 20 and 25 are normally grounded so that the natural corona discharge occurs between the wire 18 and the screen drum 16 and consequently the circuits are established as indicated by arrows 20B and 25B, respectively. As a consequence the currents flow into the secondaries (high-voltage output sides) of the power supplies 20 and 25 in the directions indicated by the arrows 20B and 25B, the magnitudes of the currents being depending upon the directions of rectifier elements 20C and 25C. Therefore the mere On-Off operation of the inputs to the primaries 20A and 25A of the power supplies 20 and 25 results in the corona discharge even when the inputs to the primaries 20A and 25A are turned off so that the primary electrostatic latent image on the screen drum 16 is distored and consequently the retention copying cannot be effected in a stable and reliable manner.

Figure 7:
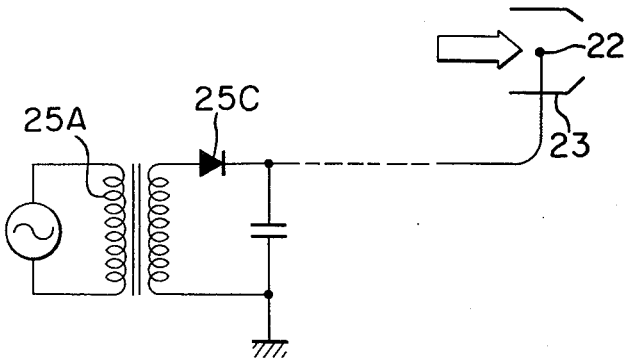
FIG. 7 is a circuit diagram of a high-voltage power supply of a second corona discharger thereof.
Figure 8:
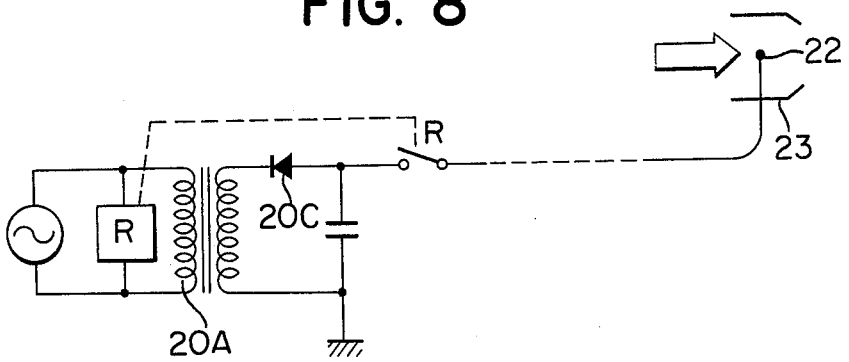
FIG. 8 is a circuit diagram used for the explanation of one of the methods in accordance with the present invention for eliminating the natural generation of corona discharges during the modulation or retention copying process.

In FIG. 7 there is shown a circuit diagram of a modification of the high-voltage power supply 25 shown in FIG. 6 for impressing a DC voltage opposite in polarity to the primary voltage impressed in the first step. One of the solutions to the problem described above is to use a relay to open and close the output side of each of the high-voltage power supplies 20 and 25, thereby electrically floating the corona discharge wires 18 and 22. That is, as shown in FIG. 8 a relay R is inserted in such a way that only when the input voltage is impressed on the primary 20A of the power supply 20, the contacts of the relay R are closed to impress the primary voltage and when no input voltage is impressed the contacts of the relay R are kept opened. Alternatively the relay R may be so arranged that it may be closed immediately before the input voltage is impressed on the primary 20A and opened simultaneous with the completion of the primary voltage impression or immediately before the step for forming the secondary electrostatic latent image.

Meanwhile upon impression of the bias voltage upon the first corona discharger 17, the corona discharge occurs not only between the corona wire 18 and its opposed electrode but also between the opposed electrode and the free sides 19A (See FIG. 6) of the shielding plate 19. One solution to this problem is to ground the shielding plate 19 and to space it from the screen drum 16 by a sufficient distance so that no natural corona discharge is induced between the shielding plate 19 and the screen drum 16. However, when it is impossible to space between them by a sufficient distance because of for instance an installation position of the corona discharger 17, the latter may be mounted on a main frame of the copying machine through an electrically insulating or isolation means. In addition when the bias voltage is impressed on the screen drum 16 to form a secondary electrostatic latent image, a voltage equal to the screen bias voltage or a voltage lower than the bias voltage and within the range causing no natural corona discharge may be impressed to the shielding member.

Alternatively a high-voltage relay is inserted to float the conductors in the manner described above in conjunction with FIG. 8. Furthermore an isolation member or material may be applied or coated to the free sides 19A of the shielding plate 19 to prevent the natural corona discharge. When a sufficient space is available between the screen drum 16 and the first corona discharger 17, the latter may be electrically floated or a shielding member made of an electrically insulating material may be interposed between the first corona discharger 17 and the screen drum 16 as will be described in more detail with reference to FIG. 9.

Figure 9:
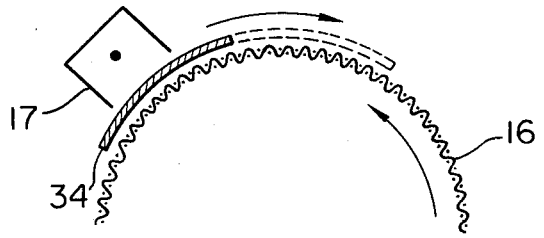
FIG. 9 is a diagram used for the explanation of another method of the type using a shielding plate.

Referring to FIG. 9 a shielding member 34 is interposed between the first corona discharger 17 and the screen drum 16 and is retracted to an inoperative position indicated by the broken lines when the primary voltage impression is effected and is returned to the position indicated by the solid lines when the bias voltage is impressed to the screen drum 16. With the methods and arrangements described above the natural corona discharge may be prevented and it is understood that the above methods and arrangements may be used singly or in combination.

So far the methods for electrically isolating the conductive member from the screen have been described, and a further isolation method will be described in conjunction with the first corona discharger. That is, the natural corona discharge may be prevented by impressing on the corona discharge wire 18 and/or shielding plate 19 a voltage equal to the bias voltage of the screen drum 16 or a voltage which may not cause the natural corona discharge.

So far the methods and arrangements for preventing the natural discharge have been described in conjunction with the first corona discharger 17, but it is to be understood that they may be equally applied to not only the second corona discharger 21 but also the shielding plates 27 and 28 and that their applications are not limited only to the first corona discharger 17. It is simpler and more preferable to electrically and normally float the shielding members 27 and 28 which are not impressed with a voltage or to line the surfaces thereof with an isolation material or member.

Next examples will be described of the method for electrically floating the corona discharger and of the method for impressing a bias voltage in order to prevent the natural corona discharge.

EXAMPLE 1

Figure 10:
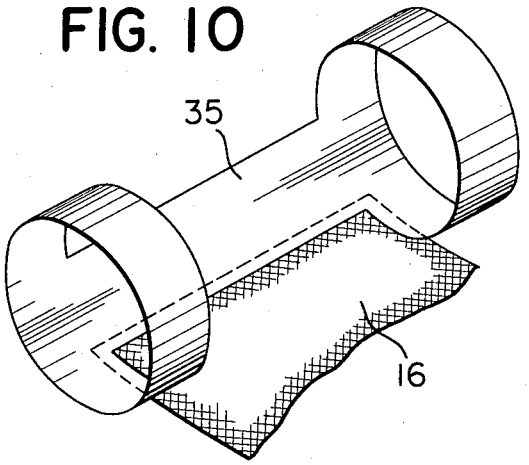
FIG. 10 is a perspective view of a frame of a screen drum.

The present invention may be practiced with a screen which may permit the retention copying and which is impressed with a high bias voltage so that in the step of modulation the ion streams may be attracted and the corona discharge may be generated in the manner described above. In EXAMPLE 1 the screen of the type shown in FIG. 1 was used. Used as the conductive member is a wire screen or gauze of 200 mesh made of stainless wires 40 microns in diameter, and the photoconductive member or selenium (Se) was deposited over one major surface of the conductive member to a maximum thickness of about 50 microns by vacuum evaporation. Next the insulating member made of "Valien" a product of Union Carbide Corp. was coated over the photoconductive member to a thickness of about 10 microns. The screen thus prepared was wrapped around a frame 35 made of an aluminum alloy (See FIG. 10) in such a way that the other major surface of the screen at which is exposed the conductive member defines the interior surface, and thereafter was firmly joined with an adhesive. The screen drum thus prepared was rotated at a peripheral speed of 160 cm/sec and was impressed with −400 V in the primary voltage impression step. Thereafter simultaneous with the projection of an original to be reproduced at a rate of 30 lux-sec the screen drum was subjected to the secondary voltage impression with the AC corona discharge which was biased to positive and was superimposed with the positive bias voltage, and thereafter the whole-surface illumination was effected at a rate of 500 lux-sec. The primary electrostatic latent image thus formed had a surface voltage of +50 V at an exposed area and a surface voltage of −200 V at an unexposed area. An electrostatic recording sheet was used as the recording member and spaced apart from the screen drum by 5 mm. The bias voltage of +5 KV was impressed to the conductive member of the screen drum, and the voltage +10 KV was impressed to the third corona discharger located within the screen drum (See FIG. 6) to form a secondary electrostatic latent image on the recording sheet which was transported in synchronism with the screen drum. The recording sheet bearing the secondary electrostatic latent image was developed by a wet developing process with negatively charged and colored toner particles. During the retention copying the corona wires (corresponding to those indicated by 18 and 22 in FIG. 1) were connected to their respective power supplies while the inputs to the primaries of the first and second high-voltage supplies were kept turned off. After a few retention copies were reproduced the primary electrostatic latent image was erased and as the retention copying proceeds the qualities of images reproduced changed over a wide range.

The above change in qualities of images on the copies reproduced by the retention copying may be attributed to the natural corona discharge which was generated between the screen drum and the third corona discharger spaced apart from the former by 10 mm during the modulation step because the shielding member (28 in FIG. 6) was coated with an electrically insulating plastic paint and the shielding plates or members of the first and second corona dischargers (17, 21) were grounded and sufficiently spaced apart from the screen drum. In order to solve this problem or the change in qualities of images the method described above in conjunction with FIG. 8 was employed. That is, the relays were inserted in such a way that the output sides of the high-voltage power supplies (20, 25) may be opened during the step for forming the primary electrostatic latent image. The result was that the change in quality of the primary electrostatic latent image could be substantially eliminated and consequently the change in image quality of 100 retention copies was very less.

EXAMPLE 2

The conductive member similar to that used in EXAMPLE 1 was used, and a solution containing pulverized cadmium sulfide as a photoconductive member and a binder solution consisting of 20% by weight of solvent type epoxy resin based on the weight of the photoconductive member was sprayed over one major surface of the conductive member, dried and polymerized. Thereafter the same binder solution was sprayed over the photoconductive member to form the insulating member.

The voltages opposite in polarity to those used in EXAMPLE 1 were used in the steps for forming a primary electrostatic latent image. In the exposure step, an original was projected at a rate of 8 lux-sec, and thereafter the screen drum was subjected to the whole-surface illumination. The primary electrostatic latent image thus formed had a surface potential −50 V at an exposed area and a surface potential +200 V at an unexposed area. Thereafter the negative corona discharge was effected by the third corona discharger to form a secondary electrostatic latent image on a recording sheet. The latent image was made visible by a dry developing process with positively charged and colored toner particles.

As with EXAMPLE 1 the output sides of the first and second high-voltage power supplies were kept connected to the corona discharge wires during the retention copying process while the inputs were kept turned off. The result was same as EXAMPLE 1. In order to solve this problem, the relays each having two contacts were inserted to electrically isolate the corona discharge wires from the high-voltage power supplies while a voltage substantially equal to the bias voltage impressed to the conductive member of the screen drum was impressed on all corona discharge wires and shielding members or plates of the corona dischargers. The result was that even after 100 continuous retention copying steps, the erasure or degradation of the primary electrostatic latent image could be substantially prevented and the 100th copy was substantially similar in image quality to the first copy.

In both EXAMPLES 1 and 2 all of the shielding plates or members were coated with an electrically insulating plastic paint so that the adverse effects due to the natural corona discharges could be completely eliminated.

As described above, the object of the present invention for completely eliminating the induction of the natural corona discharge at the conductive member may be attained by electrically isolating the conductive members in the vicinity of the screen to which is impressed the bias voltage or by impressing a suitable bias voltage on these conductive members. As a result, the degradation or destruction of the primary electrostatic latent image may be substantially eliminated in the retention copying process so that the copies may be reproduced at a high speed. In addition to the conductive members described above, there are other conductors such as auxiliary electrodes for facilitating the operation of corona dischargers and conductors of a copying machine which are not directly used in the formation of the primary and secondary electrostatic latent images. The present invention is not limited to the screen of the type described above and may be equally applied to any screens of the type which may effect the ion modulations a plurality of times from the same primary electrostatic latent image and which is impressed with a relatively high bias voltage at least during the modulation. In addition the present invention may be also equally applied to the screens of the type which may modulate the charged tonner particles or charged pigment particles in addition to the ion streams.

So far described are the methods for preventing the natural corona discharge of (i) electrically floating the conductors, (ii) applying electrically isolating means over the screen or placing said means in the vicinity of the screen, (iii) interposing suitable isolation means between the screen and the conductor, and (iv) impressing on the conductor a bias voltage sufficient for preventing the generation of the natural corona discharge. However, it should not be understood that these methods are applied only to the shielding members of the corona dischargers of the type described above. There are a variety of conductors in a copying machine such as a shielding plate placed in the vicinity of the screen for protecting it from dust, structural members in the vicinity of the screen, means for detecting a potential of a latent image and so on, to all of which the present invention may be applied. In addition the methods from (i) to (iv) may be practiced singly or in combination. So far the images of the original have been described as being reproduced on the insulating sheets, but it will be understood that instead of the insulating sheets an electrically insulating drum or the like may be used so that a developed image may be transferred onto an ordinary paper sheet.

What is claimed is:

1. A method of forming an image on a chargeable member by conducting an ion flow through a screen type photosensitive member having a large number of fine through openings, wherein a conductive member is disposed adjacent said photosensitive member, said method comprising the steps of forming a primary electrostatic latent image on said screen type photosensitive member, applying a corona ion flow from corona ion source means through said photosensitive member to the chargeable member, wherein said corona ion flow is modulated through said screen type photosensitive member by said primary latent image, applying a bias voltage to said screen and maintaining, at least during the application of the bias voltage to said screen, the conductive member adjacent said screen type photosensitive member in a state to prevent the generation of discharge from one of said conductive and photosensitive members to the other.

2. A method according to claim 1, wherein the same bias voltage is applied also to said conductive member.

3. A method according to claim 1, wherein a different bias voltage is applied to said conductive member.

4. A method according to claim 1, wherein said step of forming a primary electrostatic latent image is performed utilizing means including said conductive member.

5. A method according to claim 1, wherein said bias voltage is applied at least while applying the corona ion flow from corona ion source means through said photosensitive screen to the chargeable member.

6. A method according to claim 1, wherein said state is achieved by keeping the conductive member electrically isolated.

7. A method of forming an image on a chargeable member by conducting an ion flow through a screen type photosensitive member having a large number of fine through openings, wherein a conductive member is disposed adjacent said photosensitive member, said method comprising the steps of forming a primary electrostatic latent image on said screen type photosensitive member, applying a corona ion flow from corona ion source means through said photosensitive member to the chargeable member, wherein said corona ion flow is modulated through said screen type photosensitive member by said primary latent image, applying a bias voltage to said screen and maintaining, at least during the application of the bias voltage to said screen, the conductive member adjacent said screen type photosensitive member in a state to prevent the generation of discharge from one of said conductive and photosensitive members to the other, and wherein said state is achieved by disposing an insulating member on the conductive member at the side thereof facing said screen type photosensitive member to keep said conductive member electrically isolated.

8. A method of forming an image on a chargeable member by conducting an ion flow through a screen type photosensitive member having a large number of fine through openings, wherein a conductive member is disposed adjacent said photosensitive member, said method comprising the steps of forming a primary electrostatic latent image on said screen type photosensitive member, applying a corona ion flow from corona ion source means through said photosensitive member to the chargeable member, wherein said corona ion flow is modulated through said screen type photosensitive member by said primary latent image, applying a bias voltage to said screen and maintaining, at least during the application of the bias voltage to said screen, the conductive member adjacent said screen type photosensitive member in a state to prevent the generation of discharge from one of said conductive and photosensitive members to the other, and wherein said state is achieved by interposing a shielding material between the conductive member and said screen type photosensitive member to keep said conductive member electrically isolated.

9. A method according to claim 8, wherein said shielding material is an insulating material.

10. A method of forming an image on a chargeable member by conducting an ion flow through a screen type photosensitive member having a large number of fine through openings, wherein a conductive member is disposed adjacent said photosensitive member, said method comprising the steps of forming a primary electrostatic latent image on said screen type photosensitive member, applying a corona ion flow from corona ion source means through said photosensitive member to the chargeable member, wherein said corona ion flow is modulated through said screen type photosensitive member by said primary latent image, applying a bias voltage to said screen and maintaining, at least during the application of the bias voltage to said screen, the conductive member adjacent said screen type photosensitive member in a state to prevent the generation of discharge from one of said conductive and photosensitive members to the other, and wherein said state is achieved by applying a bias voltage to said conductive member.

11. A method of forming an image on a chargeable member by conducting an ion flow through a screen type photosensitive member having a large number of fine through openings, wherein a conductive member is disposed adjacent said photosensitive member, said method comprising the steps of forming a primary electrostatic latent image on said screen type photosensitive member, applying a corona ion flow from corona ion source means through said photosensitive member to the chargeable member, wherein said corona ion flow is modulated through said screen type photosensitive member by said primary latent image, applying a bias voltage to said screen and maintaining, at least during the application of the bias voltage to said screen, the conductive member adjacent said screen type photosensitive member in a state to prevent the generation of discharge from one of said conductive and photosensitive members to the other, and wherein said conductive member comprises a blocking plate for preventing dust from being deposited on the screen.

12. A method of forming an image on a chargeable member by conducting an ion flow through a screen type photosensitive member having a large number of fine through openings, wherein a conductive member is disposed adjacent said photosensitive member, said method comprising the steps of forming a primary electrostatic latent image on said screen type photosensitive member, applying a corona ion flow from corona ion source means through said photosensitive member to the chargeable member, wherein said corona ion flow is modulated through said screen type photosensitive member by said primary latent image, applying a bias voltage to said screen and maintaining, at least during the application of the bias voltage to said screen, the conductive member adjacent said screen type photosensitive member in a state to prevent the generation of discharge from one of said conductive and photosensitive members to the other, and providing means for detecting a potential of the latent image formed on said screen, and wherein said conductive member comprises a portion of said detecting means.

13. A method of forming an image on a chargeable member by conducting an ion flow through a screen type photoconductive member which is stretched by a drum frame to form a screen type drum, wherein a conductive member is disposed adjacent said screen drum, said method comprising the steps of forming a primary electrostatic latent image on said screen type photosensitive member, applying a corona ion flow from corona ion source means through said photosensitive member to the chargeable member, wherein said corona ion flow is modulated through said screen type photosensitive member by said primary latent image, and keeping the conductive member adjacent said screen drum in a state to prevent the generation of discharge from one to the other of said conductive member and screen drum.

14. An image formation apparatus which includes a screen type photosensitive member having a number of openings, means for forming a primary electrostatic latent image thereon, means for passing a flow of ions through the openings of said screen type photosensitive member bearing the primary latent image to form a secondary image on a chargeable member, and means for applying a bias voltage to said photosensitive member, said apparatus comprising a conductive member disposed adjacent to said screen type photosensitive member, wherein a potential difference is established between said photosensitive and conductive members, and means for preventing discharge between said screen type member and the conductive member which discharge would otherwise result from said potential difference, at least during the application of the bias voltage to said photosensitive member by said bias means.

15. An apparatus according to claim 14, further comprising means for driving said screen type photosensitive member, a conductive member disposed along and adjacent to a path of movement of said driven screen type member, and means for applying a bias voltage to said screen type member when forming said secondary image on said chargeable member.

16. An apparatus according to claim 14, wherein said discharge preventing means maintains the conductive member electrically isolated.

17. An image formation apparatus which includes a screen type photosensitive member having a number of openings, means for forming a primary electrostatic latent image thereon, means for passing a flow of ions through the openings of said screen type photosensitive member bearing the primary latent image to form a secondary image on a chargeable member, and means for applying a bias voltage to said photosensitive member, said apparatus comprising a conductive member disposed adjacent to said screen type photosensitive member, wherein a potential difference is established between said photosensitive and conductive members, and means for preventing discharge between said screen type member and the conductive member which discharge would otherwise result from said potential difference, at least during the application of the bias voltage to said photosensitive member by said bias means, wherein said discharge preventing means includes an insulating member disposed on the conductive member at the side thereof facing said screen type member to electrically isolate said conductive member.

18. An image formation apparatus which includes a screen type photosensitive member having a number of openings, means for forming a primary electrostatic latent image thereon, means for passing a flow of ions through the openings of said screen type photosensitive member bearing the primary latent image to form a secondary image on a chargeable member, and means for applying a bias voltage to said photosensitive member, said apparatus comprising a conductive member disposed adjacent to said screen type photosensitive member, wherein a potential difference is established between said photosensitive and conductive members, and means for preventing discharge between said screen type member and the conductive member which discharge would otherwise result from said potential difference, at least during the application of the bias voltage to said photosensitive member by said bias means, wherein said discharge preventing means includes a material interposed between the conductive member and said screen type member to electrically isolate said conductive member.

19. An apparatus according to claim 18, wherein said material is an insulating material.

20. An image formation apparatus which includes a screen type photosensitive member having a number of openings, means for forming a primary electrostatic latent image thereon, means for passing a flow of ions through the openings of said screen type photosensitive member bearing the primary latent image to form a secondary image on a chargeable member, and means for applying a bias voltage to said photosensitive member, said apparatus comprising a conductive member disposed adjacent to said screen type photosensitive member, wherein a potential difference is established between said photosensitive and conductive members, and means for preventing discharge between said screen type member and the conductive member which discharge would otherwise result from said potential difference, at least during the application of the bias voltage to said photosensitive member by said bias means, wherein said discharge preventing means comprises, means for applying a bias voltage to said conductive member.

21. An apparatus according to claim 20, wherein the bias applying means applies the same bias voltage to both said screen type and conductive members.

22. An apparatus according to claim 20, wherein said bias voltage applied to said screen type member is different than that applied to said conductive member.

23. An image formation apparatus which includes a screen type photosensitive member having a number of openings, means for forming a primary electrostatic latent image thereon, means for passing a flow of ions through the openings of said screen type photosensitive member bearing the primary latent image to form a secondary image on a chargeable member, and means for applying a bias voltage to said photosensitive member, said apparatus comprising a conductive member disposed adjacent to said screen type photosensitive member, said conductive member comprises blocking means for preventing dust from reaching said screen type member, wherein a potential difference is established between said photosensitive and conductive members, and means for preventing discharge between said screen type member and the conductive member which discharge would otherwise result from said potential difference, at least during the application of the bias voltage to said photosensitive member by said bias means.

24. An image formation apparatus which includes a screen type photosensitive member having a number of openings, means for forming a primary electrostatic latent image thereon, means for passing a flow of ions through the openings of said screen type photosensitive member bearing the primary latent image to form a secondary image on a chargeable member and means for applying a bias voltage to said photosensitive member, said apparatus comprising a corona discharger having a conductive member disposed adjacent to said screen type photosensitive member, wherein a potential difference is established between said photosensitive and conductive members, and means for preventing discharge between said screen type member and the conductive member which discharge would otherwise result from said potential difference, at least during the application of the bias voltage to said photosensitive member by said bias means.

25. An image formation apparatus which includes a screen type photosensitive member having a number of openings, means for forming a primary electrostatic latent image thereon, means for passing a flow of ions through the openings of said screen type photosensitive member bearing the primary latent image to form a secondary image on a chargeable member, and means for applying a bias voltage to said photosensitive member, said apparatus comprising a light-blocking plate having a conductive member disposed adjacent to said screen type photosensitive member, wherein a potential difference is established between said photosensitive and conductive members, and means for preventing discharge between said screen type member and the conductive member which discharge would otherwise result from said potential difference, at least during the application of the bias voltage to said photosensitive member by said bias means.

26. An image formation apparatus which includes a screen type photosensitive member having a number of openings, means for forming a primary electrostatic latent image thereon, means for passing a flow of ions through the openings of said screen type photosensitive member bearing the primary latent image to form a secondary image on a chargeable member, and means for applying a bias voltage to said photosensitive member, said apparatus comprising a conductive member disposed adjacent to said screen type photosensitive member, wherein a potential difference is established between said photosensitive and conductive members, and means for preventing discharge between said screen type member and the conductive member which discharge would otherwise result from said potential difference, at least during the application of the bias voltage to said photosensitive member by said bias means, wherein said conductive member comprises means for detecting a potential of the latent image formed on said screen type member.

27. An image formation apparatus which includes a screen drum having a conductive drum frame and having a screen type photosensitive member with a number of openings stretched thereon, means for forming a primary electrostatic latent image on said photosensitive member, and means for passing a flow of ions through the openings of said photosensitive member to form a secondary image on a chargeable member, said apparatus comprising driving means for rotating said screen drum, a conductive member disposed adjacent to said screen drum, and means for preventing discharging between said screen drum and said conductive member.

28. A method of forming an image on a chargeable member by conducting an ion flow through a screen type photosensitive member having a large number of fine through openings, wherein a conductive member, which is a part of a corona discharger means, is disposed adjacent said photosensitive member, said method comprising the steps of forming a primary electrostatic latent image on said screen type photosensitive member, applying a corona ion flow from corona ion source means through said photosensitive member to the chargeable member, wherein said corona ion flow is modulated through said screen type photosensitive member by said primary latent image, applying a bias voltage to said screen, and maintaining, at least during the application of the bias voltage to said screen, the conductive member adjacent said screen type photosensitive member in a state to prevent the generation of discharge from one of said conductive and photosensitive members to the other.

* * * * *

UNITED STATES PATENT AND TRADEMARK OFFICE

CERTIFICATE OF CORRECTION

PATENT NO. : 4,265,531

DATED : May 5, 1981

INVENTOR(S) : KATSUNOBU OHARA, ET AL.

It is certified that error appears in the above—identified patent and that said Letters Patent is hereby corrected as shown below:

Column 1

Line 40, after "is" (second occurrence) insert --in--.

Column 3

Line 26, delete "coating" (first occurrence).

Column 5

Line 9, delete "be"

Column 9

Line 59, change "tonner" to read --toner--.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*